US009245472B2

(12) United States Patent
Jang et al.

(10) Patent No.: US 9,245,472 B2
(45) Date of Patent: Jan. 26, 2016

(54) DISPLAY DEVICE HAVING RGBW SUB-PIXELS AND METHOD FOR DRIVING THE DISPLAY DEVICE

(71) Applicant: Samsung Display Co., Ltd., Yongin, Gyeonggi-do (KR)

(72) Inventors: Won-Woo Jang, Yongin (KR); Jong-Woong Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 262 days.

(21) Appl. No.: 13/934,155

(22) Filed: Jul. 2, 2013

(65) Prior Publication Data

US 2014/0184655 A1 Jul. 3, 2014

(30) Foreign Application Priority Data

Dec. 28, 2012 (KR) ..... 10-2012-0157329

(51) Int. Cl.
*G09G 5/10* (2006.01)
*G09G 3/20* (2006.01)
*G09G 3/32* (2006.01)

(52) U.S. Cl.
CPC ..... *G09G 3/2003* (2013.01); *G09G 3/3208* (2013.01); *G09G 3/3225* (2013.01); *G09G 2300/0452* (2013.01); *G09G 2320/043* (2013.01); *G09G 2320/0666* (2013.01); *G09G 2330/021* (2013.01); *G09G 2340/06* (2013.01)

(58) Field of Classification Search
CPC ..... G09G 3/3225
USPC ..... 345/83, 173, 690
See application file for complete search history.

(56) References Cited

U.S. PATENT DOCUMENTS

| | | | | |
|---|---|---|---|---|
| 7,742,026 | B2 | 6/2010 | Lee et al. | |
| 2003/0164810 | A1* | 9/2003 | Kim | 345/63 |
| 2005/0110906 | A1* | 5/2005 | Lee et al. | 348/673 |
| 2008/0297448 | A1* | 12/2008 | Mizukoshi et al. | 345/76 |
| 2010/0091030 | A1* | 4/2010 | Park et al. | 345/589 |
| 2010/0103187 | A1* | 4/2010 | Linssen | 345/590 |
| 2011/0007100 | A1* | 1/2011 | Yoshida | 345/690 |

(Continued)

FOREIGN PATENT DOCUMENTS

| | | |
|---|---|---|
| KR | 10-2007-0011830 | 1/2007 |
| KR | 10-2008-0061772 | 3/2008 |

(Continued)

*Primary Examiner* — Alexander Eisen
*Assistant Examiner* — Kebede Teshome
(74) *Attorney, Agent, or Firm* — Christie, Parker & Hale, LLP

(57) ABSTRACT

A display device including a data mapping unit configured to identify a minimum value of the three-color input data corresponding to red, green, and blue (RGB), to determine white output color data by multiplying the identified minimum value by a gain ratio, and to subtract the white output color data from each of the three-color input data to determine RGB output color data, a gain adjustment unit configured to determine a preliminary gain ratio to minimize standard deviations of each of the white and RGB output color data, and to change a preliminary gain ratio based on an accumulated sum of color data used for respective sub-pixels in a previously displayed image to determine the gain ratio, and a display unit including unit pixels, each including RGB and white sub-pixels, and configured to display an image which corresponds to the and RGB output color data.

28 Claims, 8 Drawing Sheets

(56) References Cited

U.S. PATENT DOCUMENTS

2011/0292087 A1 12/2011 Lim
2013/0120472 A1* 5/2013 Byun et al. ..... 345/690

FOREIGN PATENT DOCUMENTS

KR 10-2009-0078219 A 7/2009
KR 10-2011-0130126 12/2011

* cited by examiner

DISPLAY DEVICE HAVING RGBW SUB-PIXELS AND METHOD FOR DRIVING THE DISPLAY DEVICE

CROSS-REFERENCE TO RELATED PATENT APPLICATION

This application claims priority to and the benefit of Korean Patent Application No. 10-2012-0157329, filed on Dec. 28, 2012, in the Korean Intellectual Property Office, the disclosure of which is incorporated herein in its entirety by reference.

BACKGROUND

1. Field

The present invention relates to a display device, and more particularly, to a display device having RGBW sub-pixels.

2. Description of the Related Art

Recently, in an organic light-emitting diode (OLED) TV field, a white OLED (WOLED) technique has been actively discussed which is favorable to manufacturing of high-resolution large-area OLEDs. The WOLED additionally includes white-color sub-pixels, such that color data of a white portion of an RGB signal may be implemented without use of a color filter. Because the color filter is not used, brightness reduction caused by the color filter does not occur.

When a display panel of an WOLED display device which uses RGBW sub-pixels is driven, the white color may be implemented in two ways: first, the white color may be implemented with white-color sub-pixels which do not pass through the color filter and second, the white color may be implemented by combining red, green, and blue which are implemented through RGB color filters.

SUMMARY

The present invention provides a display device which improves or optimizes a trade-off relationship between a lifespan problem and a power consumption problem due to white color driving in WOLED display driving.

According to one embodiment of the present invention, there is provided a display device including: a data mapping unit configured to identify a minimum value of three-color input data corresponding to red, green, and blue, to determine white output color data by multiplying the identified minimum value by a gain ratio, and to subtract the white output color data from each of the three-color input data to determine red, green, and blue output color data; a gain adjustment unit configured to determine a preliminary gain ratio to minimize standard deviations of the white output color data and each of the red, green, and blue output color data, and to change the preliminary gain ratio based on an accumulated sum of color data used for respective sub-pixels in a previously displayed image to determine the gain ratio; and a display unit including unit pixels, each including red, green, blue, and white sub-pixels from among the respective sub-pixels, and configured to display an image corresponding to the white output color data and the red, green, and blue output color data.

The gain adjustment unit may be configured to determine the gain ratio, for the respective unit pixels included in the display unit, based on the accumulated sum of color data used for the respective sub-pixels in the previously displayed image.

The gain adjustment unit is configured to determine the gain ratio, for every frame of the displayed image, based on the accumulated sum of color data used for the respective sub-pixels in the previously displayed image.

The gain adjustment unit may be configured to receive the three-color input data, to calculate expected output color data for each of red, green, blue, and white with respect to a test gain ratio while changing the test gain ratio within a range of 0 and 1 at intervals, and to calculate standard deviations of the calculated expected output color data, and to determine the test gain ratio corresponding to a minimum of the calculated standard deviations of the calculated expected output color data as the preliminary gain ratio of a corresponding pixel.

The gain adjustment unit may be further configured to change the gain ratio based on a saturation used in the displayed image.

The gain adjustment unit may be configured to divide the minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

The saturation weight value may be determined based on a display situation.

The gain adjustment unit may be configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

According to another embodiment of the present invention, there is provided a method of driving a display device including red, green, blue and white sub-pixels, the method including: determining, by a gain adjustment unit, a preliminary gain ratio to minimize standard deviations of white output color data and each of red, green, and blue output color data; changing, by the gain adjustment unit, the preliminary gain ratio based on an accumulated sum of color data used for the respective sub-pixels in a previously displayed image to determine a gain ratio; and converting, by a data mapping unit, three-color input data corresponding to red, green, and blue into four-color output data corresponding to white, red, green, and blue by using the determined gain ratio.

The converting, by the data mapping unit, the three-color input data into the four-color output data may include: identifying a minimum value of the three-color input data corresponding to red, green, and blue; multiplying the identified minimum value by the gain ratio to determine the white output color data; and subtracting the white output color data from the respective three-color input data to determine the output color data of red, green, and blue.

The method may further include displaying, by a display panel, an image corresponding to the white output color data and the red, green, and blue output color data.

The method may further include determining, by the gain adjustment unit, the gain ratio, for a respective plurality of unit pixels included in a display panel, based on the accumulated sum of color data used for the respective sub-pixels in a previously displayed image.

The method may further include determining, by the gain adjustment unit, the gain ratio, for every frame of a displayed image, based on the accumulated sum of color data used for the respective sub-pixels in a previously displayed image.

The determining, by the gain adjustment unit, the preliminary gain ratio includes: calculating expected output color data for each of red, green, blue, and white with respect to a test gain ratio while changing the test gain ratio; calculating a standard deviation of the calculated expected output color data; and determining the test gain ratio which minimizes the standard deviation of the calculated expected output color data as a preliminary gain ratio of a corresponding pixel.

The method may further include changing, by the gain adjustment unit, the gain ratio based on a saturation used in the displayed image.

According to another embodiment of the present invention, there is provided a display device including: a display panel including unit pixels, each including red, green, blue, and white sub-pixels; a data driver configured to supply a four-color data signal corresponding to red, green, blue, and white output color data to each of the unit pixels; a gate driver configured to supply a gate-on voltage to the unit pixels; and a timing controller configured to control a driving of the data driver and the gate driver and to supply the white output color data and output color data of the red, green, and blue sub-pixels to the data driver, wherein the timing controller includes: a data mapping unit configured to identify a minimum value of three-color input data corresponding to red, green, and blue, to determine white output color data by multiplying the identified minimum value by a gain ratio, and to subtract the white output color data from each of the three-color input data to determine output color data of red, green, and blue; and a gain adjustment unit configured to determine a preliminary gain ratio to minimize standard deviations of the white output color data and each of the red, green, and blue output color data, and to change a preliminary gain ratio based on an accumulated sum of color data used for the respective red, green, blue, and white sub-pixels in a previously displayed image to determine the gain ratio.

The gain adjustment unit may be configured to determine the gain ratio, for the respective unit pixels included in the display panel, based on the accumulated sum of color data used for the respective sub-pixels in the previously displayed image.

The gain adjustment unit may be configured to determine the gain ratio, for every frame of the displayed image, based on the accumulated sum of color data used for the respective sub-pixels in the previously displayed image.

The gain adjustment unit may be configured to receive the three-color input data, to calculate expected output color data for each of red, green, blue, and white with respect to a test gain ratio while changing the test gain ratio within a range of 0 and 1 at predetermined intervals, and to calculate standard deviations of the calculated expected output color data, and to determine the test gain ratio corresponding to a minimum of the calculated standard deviations of the calculated expected output color data as the preliminary gain ratio of a corresponding pixel.

The gain adjustment unit may change the gain ratio based on a saturation used in the displayed image.

The gain adjustment unit may be configured to divide a minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

The saturation weight value may be determined based on a display situation.

The gain adjustment unit may be configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

According to another embodiment of the present invention, there is provided a display device including: a data mapping unit configured to identify a minimum value of three-color input data corresponding to red, green, and blue, to determine white output color data by multiplying the identified minimum value by a gain ratio, and to subtract the white output color data from each of the three-color input data to determine the red, green, and blue output color data; and a gain adjustment unit configured to determine a preliminary gain ratio to minimize standard deviations of the white output color data and each of the red, green, and blue output color data, and to change the preliminary gain ratio based on an accumulated sum of color data used for respective sub-pixels in a previously displayed image and saturation data corresponding to the three-color input data, to determine the gain ratio for respective unit pixels included in a display panel; and a display unit including the unit pixels, each including red, green, blue, and white sub-pixels from among the respective sub-pixels, and displays an image corresponding to the white output color data and the red, green, and blue output color data.

The gain adjustment unit may be configured to receive the three-color input data, to calculate expected output color data for each of red, green, blue, and white with respect to a test gain ratio while changing the test gain ratio within a range of 0 and 1 at predetermined intervals, and calculates standard deviations of the calculated expected output color data, and to determine the test gain ratio corresponding to a minimum of the calculated standard deviations of the calculated expected output color data as the preliminary gain ratio of a corresponding pixel.

The gain adjustment unit may be configured to divide a minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

The saturation weight value may be determined based on a display situation.

The gain adjustment unit may be configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

BRIEF DESCRIPTION OF THE DRAWINGS

The above and other features and embodiments of the present invention will become more apparent by describing in detail exemplary embodiments thereof with reference to the attached drawings in which.

DETAILED DESCRIPTION OF THE INVENTION

Figure 1:
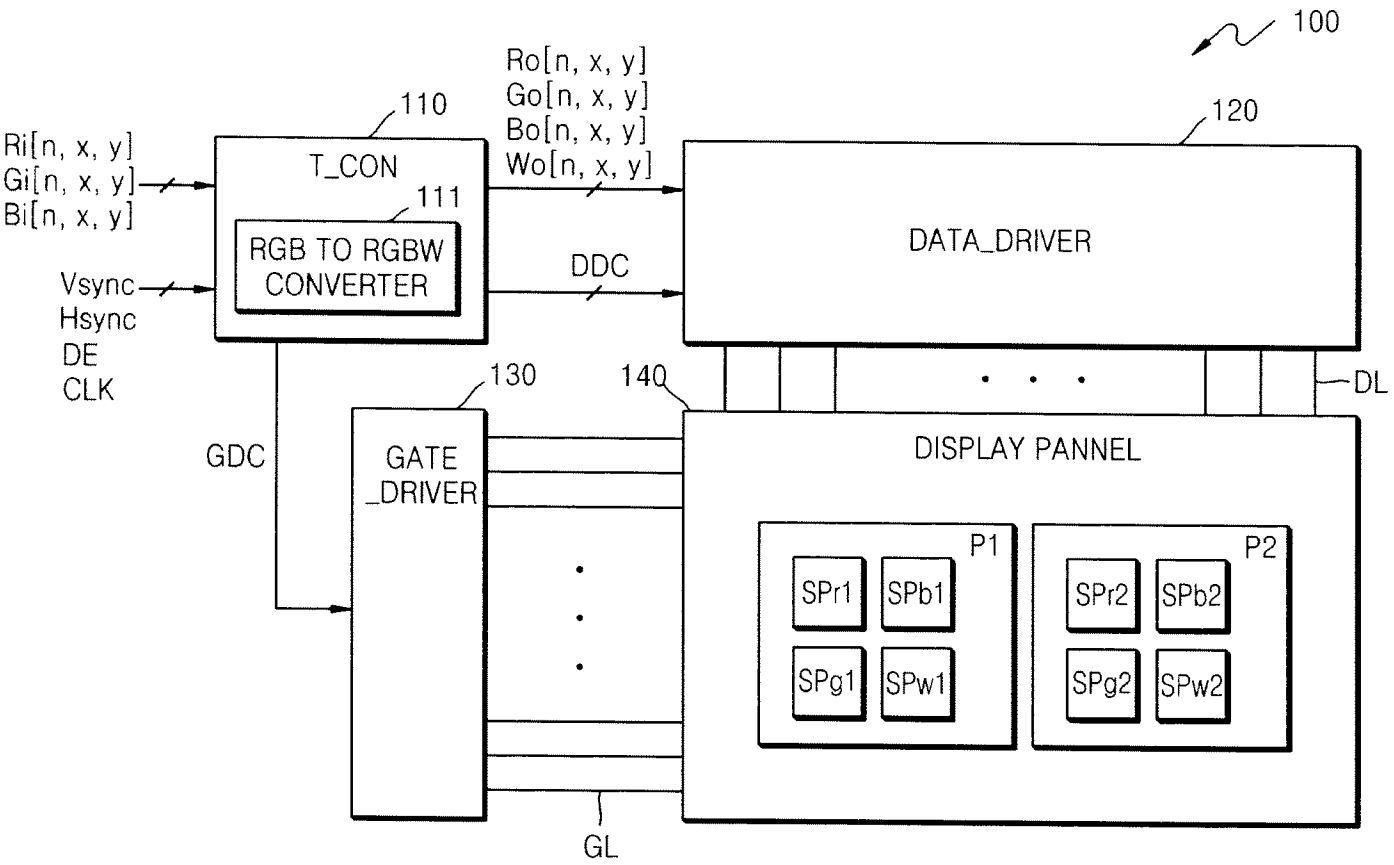
FIG. 1 is a block diagram of a display device, according to an embodiment of the present invention.

Hereinafter, embodiments of the present invention will be described with reference to the accompanying drawings. The embodiments of the present invention are provided to more completely describe the present invention to those of ordinary skill in the art. Various changes may be made to the present invention, and the present invention may have various forms, several embodiments of which will be illustrated in the drawings and described in detail. However, such embodiments are not intended to limit the present invention to the disclosed embodiments and it should be understood that the embodiments include all changes, equivalents, and substitutes within the spirit and scope of the present invention. Throughout the drawings, like reference numerals refer to like components. For purpose of clarity, in the accompanying drawings, structures and/or components contained therein may not be illustrated to scale and may be out of proportion relative to one another.

The terminology used herein is only for the purpose of describing an embodiment and is not intended to be limiting of an exemplary embodiment. As used herein, the singular forms are intended to include the plural forms as well, unless the context clearly indicates otherwise. It will be further understood that the terms "comprises" and/or "has" when used in this specification, specify the presence of a stated feature, number, step, operation, component, element, or a combination thereof but do not preclude the presence or addition of one or more other features, numbers, steps, operations, components, elements, or combinations thereof.

As used herein, terms such as "first," "second," etc., are used to describe various components. However, it is obvious that the components should not be defined by these terms. The terms are used only for distinguishing one component from another component. For example, a first component may be referred to as a second component and, likewise, a second component may also be referred to as a first component, without departing from the teaching of the present invention.

The terms used herein, including technical and scientific terms, have the same meanings as terms that are generally understood by those skilled in the art, unless otherwise defined. It should be understood that terms defined in a generally-used dictionary have meanings coinciding with those of terms in the related technology.

FIG. 1 is a block diagram of a display device 100, according to an embodiment of the present invention.

Referring to FIG. 1, the display device 100 includes a display panel 140, a timing controller 110, a data driver 120, and a gate driver 130.

In the display panel 140, multiple data lines DL and multiple gate lines GL cross each other and a plurality of pixels, for example, pixels P1 and P2, each including four sub-pixels, are arranged at display regions where the data lines DL and the gate lines GL cross each other. The pixel P1 may include an R sub-pixel SPr1 for generating red (R) light, a G sub-pixel SPg1 for generating green (G) light, a B sub-pixel SPb1 for generating blue (B) light, and a W sub-pixel Spw1 for generating white (W) light. Likewise, the pixel P2 may include an R sub-pixel SPr2, a G sub-pixel SPg2, a B sub-pixel SPb2, and a W sub-pixel SPw2.

While the two pixels are shown in FIG. 1, they are merely for convenience of description, and the number of pixels included in the display panel 140 may vary according to a particular application.

Figure 2A:
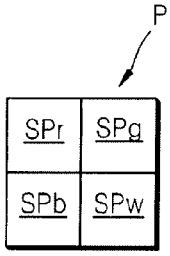
FIGS. 2A through 2C are diagrams illustrating various arrangements of sub-pixels in one pixel, according to embodiments of the present invention.
Figure 2B:
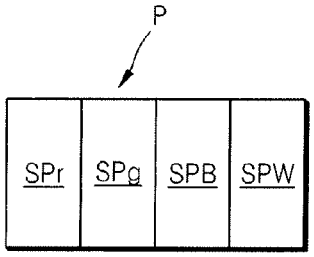
Figure 2C:
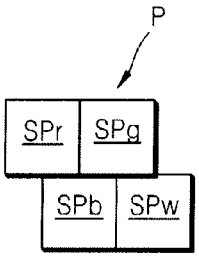

FIGS. 2A through 2C are diagrams showing various arrangements of sub-pixels in one pixel.

Referring to FIGS. 2A through 2C, in one pixel P, sub-pixels may form a checker arrangement at crossing regions of two data lines and two gate lines as shown in FIG. 2A, may form a stripe arrangement at crossing regions of four data lines and one gate line as shown in FIG. 2B, or may form a checker arrangement at crossing regions of two data lines and two gate lines in which sub-pixels SPr and SPg at an upper row and sub-pixels SPb and SPw on a lower row are arranged in a crisscross fashion (e.g., offset from each other in a direction parallel to the gate lines).

Figure 3:
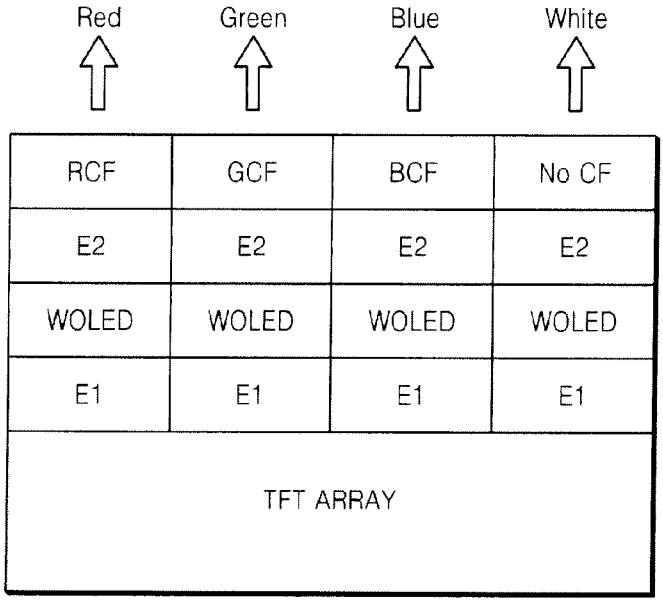
FIG. 3 is a schematic diagram illustrating a stacked structure of sub-pixels in one pixel, according to embodiments of the present invention.

FIG. 3 is a schematic diagram illustrating a stacked structure of sub-pixels in one pixel, according to embodiments of the present invention.

Referring to FIG. 3, sub-pixels SPr, SPg, SPb, and SPw include WOLEDs, respectively. A WOLED has a structure in which an R light-emission layer, a G light-emission layer, and a B light-emission layer are selectively stacked between a cathode electrode and an anode electrode. The WOLED is formed in sub-pixel units. As shown in FIG. 3, the R sub-pixel SPr includes an R color filter (RCF) which passes only R light of W light incident from the WOLED therethrough; the G sub-pixel SPg includes a GCF which passes only G light of the W light therethrough; and the B sub-pixel SPb includes a BCF which passes only B light of the W light therethrough. The W sub-pixel SPw does not include a color filter and passes the W light therethrough, thereby compensating for degradation of luminance of an image due to the RCF, the GCF, and the BCF.

In FIG. 3, 'E1' may indicate an anode electrode (or a cathode electrode), and 'E2' may indicate a cathode electrode (or an anode electrode). 'E1' is electrically coupled to a driving thin film transistor (TFT) formed in a lower TFT array on a sub-pixel basis. The TFT array includes a driving TFT, at least one switching TFT, and a storage capacitor for each sub-pixel, and is coupled to a data line DL and a gate line GL on a sub-pixel basis.

Referring to FIG. 1, the data driver 120 converts four-color compensation data Ro[n, x, y], Go[n, x, y], Bo[n, x, y], and Wo[n, x, y], whose color coordinates have been converted into analog data voltages, and provides the analog data voltages to the data lines DL, under control of the timing controller 110. Herein, n indicates a number corresponding to a frame, and x and y indicate numbers corresponding to a position of a pixel to which color data is provided.

Under control of the timing controller 110, the gate driver 130 generates a scan pulse and sequentially provides the generated scan pulse to the gate lines GL, thus selecting a horizontal line to which the data voltage is to be applied.

The timing controller 110 generates a data control signal DDC for controlling the timing of the operation of the data driver 120 and a gate control signal GDC for controlling the timing of the operation of the gate driver 130, based on timing signals such as a vertical sync signal Vsync, a horizontal sync signal Hsync, a clock signal CLK, and a data enable signal DE.

The timing controller 110 may include an RGB-to-RGBW converter 111. The RGB-to-RGBW converter 111 receives three-color input color data Ri[n, x, y], Gi[n, x, y], and Bi[n, x, y] which are supplied by an external source, and provides four-color output data Ro[n, x, y], Go[n, x, y], Bo[n, x, y], and Wo[n, x, y] whose color coordinates are converted and transmitted to the data driver 120. However, in another embodiment, the RGB-to-RGBW converter 111 may be implemented in the data driver 120, or a separate chip and may be changed according to a particular application.

When respective sub-pixels included in a display panel 140 are driven, several methods may be used to implement the color white, for example, white may be implemented with white sub-pixels which do not pass through a color filter, or white may be implemented by combining red, green, and blue, which are implemented through an RGB color filter.

As the number of white sub-pixels which implement white increases, a drive load is concentrated in the white sub-pixels, such that degradation of the white sub-pixels rapidly progresses, shortening the overall lifespan of the pixel. On the other hand, as the rate of red, green, and blue sub-pixels, which implement white, increases, power consumption increases due to the use of all the red, green, and blue sub-pixels.

Therefore, the lifespan problem and the power consumption problem have a trade-off relationship, such that there is a need for a way to properly determine a gain ratio ga.

A display device, according to an embodiment of the present invention, includes a data mapping unit and a gain adjustment unit to improve or optimize a gain ratio ga based on at least one of a standard deviation, a saturation value, or an accumulated color data value of output color data, thereby implementing a pixel having both a long lifespan and low power consumption. An operation of converting color coordinates of three-color input data Ri[n, x, y], Gi[n, x, y], and Bi[n, x, y] into four-color output data Ro[n, x, y], Go[n, x, y], Bo[n, x, y], and Wo[n, x, y] will be described in detail below.

Figure 4A:
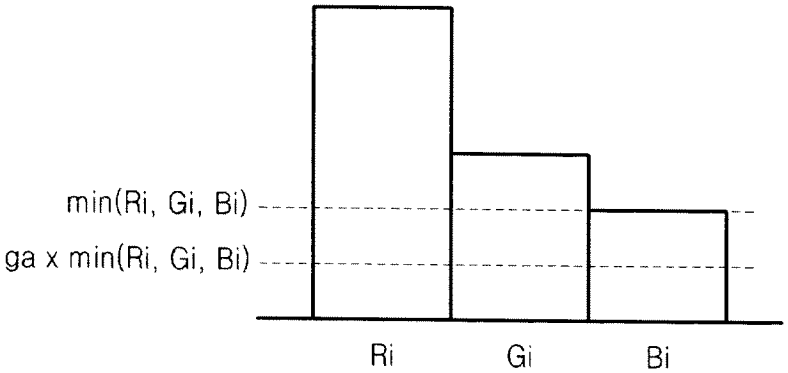
FIGS. 4A and 4B are graphs for describing an operation of converting color coordinates of three-color input data RiGiBi into four-color output data RoGoBoWo, according to embodiments of the present invention.
Figure 4B:
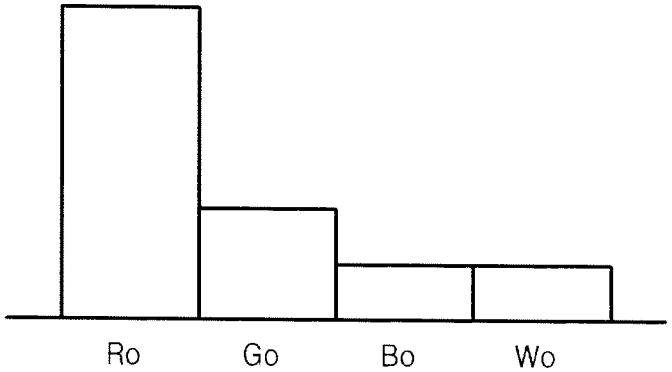

FIGS. 4A and 4B are graphs for describing an operation of converting color coordinates of three-color input data RiGiBi into four-color output data RoGoBoWo, according to one embodiment of the present invention.

Referring to FIGS. 4A and 4B, an operation of converting color coordinates of three-color input data RiGiBi into four-color output data RoGoBoWo may be divided into the following stages or steps. First, a minimum value of the three-color input data RiGiBi is identified. Second, the identified minimum value and a gain ratio ga are multiplied together to determine white output color data. Third, the white output color data is subtracted from the respective three-color input data to determine red output color data, green output color data, and blue output color data. This may be expressed as follows:

$$Wo = ga \times \min[Ri, Gi, Bi]$$

$$Ro = Ri - Wo$$

$$Go = Gi - Wo$$

$$Bo = Bi - Wo \quad (1)$$

wherein the gain ratio ga is more than 0 and less than 1. Thus, for a high gain ratio, a relative ratio of white sub-pixels which implement white is high; for a low gain ratio, a relative ratio of red, green, and blue sub-pixels which implement white is high.

The display device, according to embodiments of the present invention, includes a data mapping unit and a gain adjustment unit to improve or optimize a gain ratio based on at least one of a standard deviation, a saturation value, and a used accumulated color data value of output color data, thereby implementing a pixel having a long-term lifespan with low power consumption.

More specifically, the gain adjustment unit, according to an embodiment of the present invention, determines a preliminary gain ratio to minimize a standard deviation between white output color data and each of red, green, and blue output color data, and changes the preliminary gain ratio based on an accumulated sum of color data used for each sub-pixel (R sub-pixel, G sub-pixel, or B sub-pixel) in a previously displayed image, to determine the gain ratio.

Figure 5:
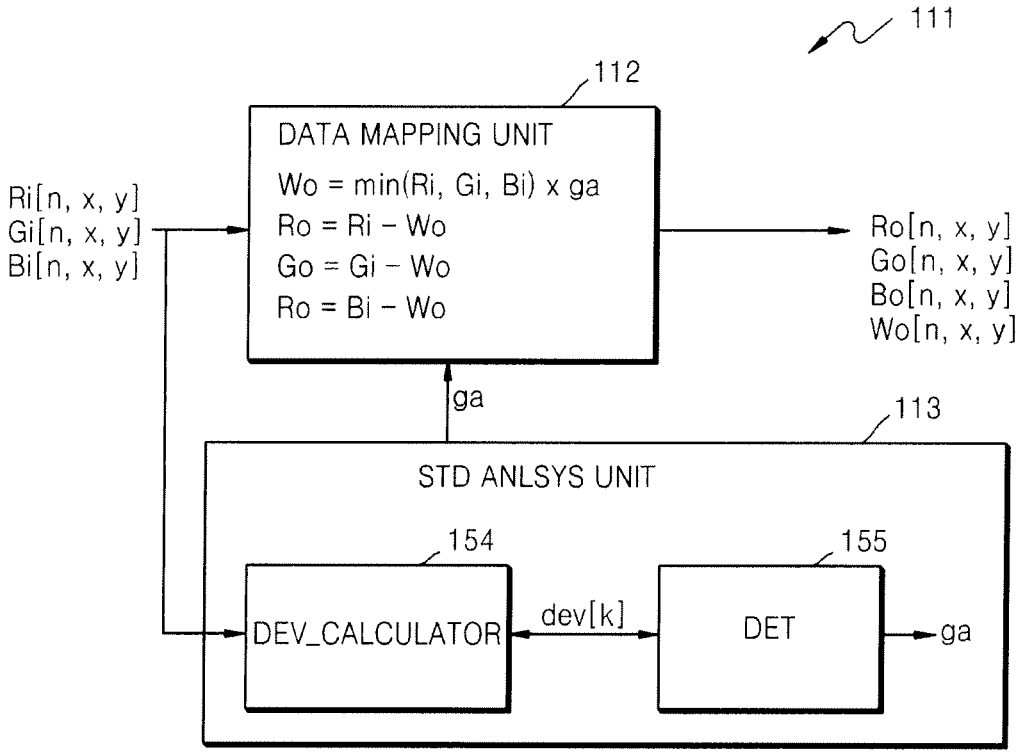
FIG. 5 is a diagram illustrating in detail an RGB-to-RGBW converter according to an embodiment of the present invention.

FIG. 5 is a diagram illustrating in detail a RGB-to-RGBW converter 111-1 (which corresponds to RGB-to-RGBW converter 111 of FIG. 1), according to an embodiment of the present invention.

Referring to FIG. 5, the RGB-to-RGBW converter 111-1 includes a data mapping unit 112 and a standard deviation (STD) analysis unit 113.

The data mapping unit 112 receives three-color input data Ri[n, x, y], Gi[n, x, y], and Bi[n, x, y] and generates four-color output data Ro[n, x, y], Go[n, x, y], Bo[n, x, y], and Wo[n, x, y]. The data mapping unit 112 also receives a gain ratio ga from the STD analysis unit 113 and uses the received gain ratio for generation of the four-color output data Ro[n, x, y], Go[n, x, y], Bo[n, x, y], and Wo[n, x, y].

The STD analysis unit 113 includes a deviation calculator 154 and a comparator 155.

The deviation calculator 154 receives three-color input data Ri[n, x, y], Gi[n, x, y], and Bi[n, x, y] for a position (x, y) of each pixel for each frame. The deviation calculator 154 calculates standard deviations of expected output color data for test gain ratios ga Jest and sends the calculated standard deviations to the comparator 155. The comparator 155 determines the test gain ratio ga_test corresponding to the minimum value from among the delivered standard deviations as the gain ratio ga.

Figure 6:
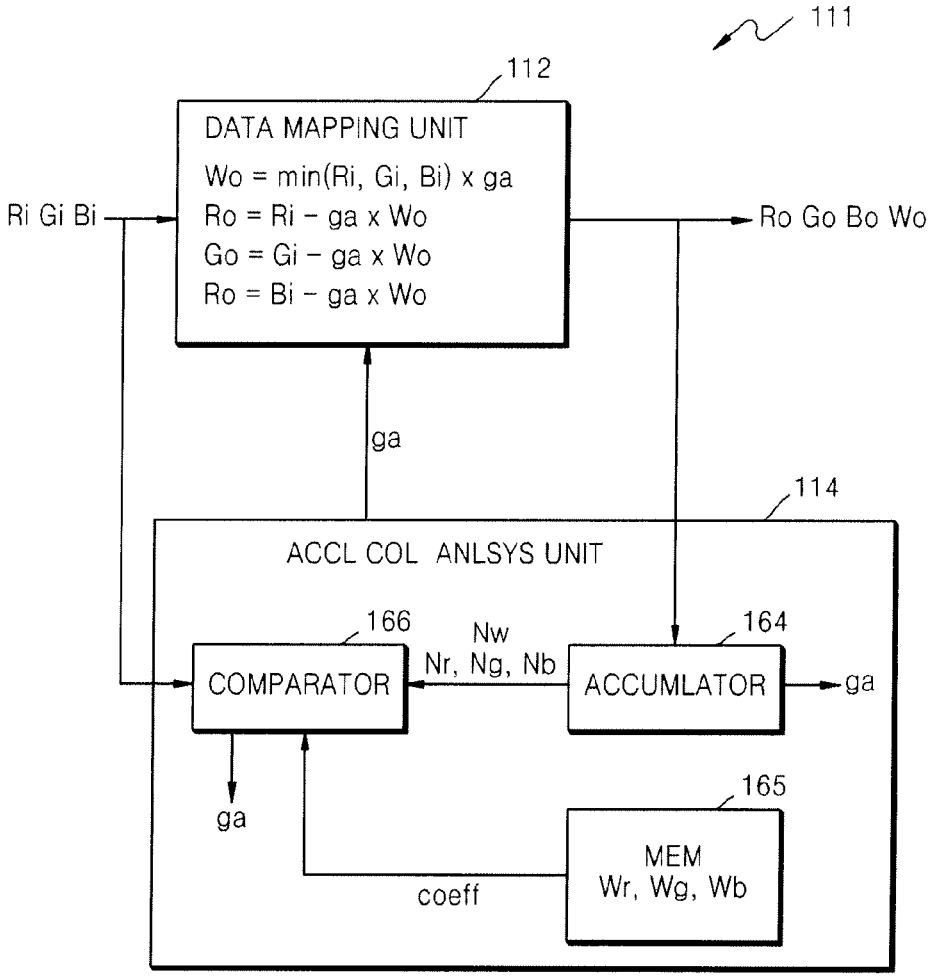
FIG. 6 is a diagram illustrating in detail an RGB-to-RGBW converter, according to an embodiment of the present invention.

FIG. 6 is a diagram illustrating in detail a RGB-to-RGBW converter 111-2 (which corresponds to RGB-to-RGBW converter 111 of FIG. 1), according to another embodiment of the present invention.

Referring to FIG. 6, the RGB-to-RGBW converter 111-2 includes the data mapping unit 112 and an accumulated color analysis unit 114 that uses a feedback mechanism for calculating the gain ratio ga.

The data mapping unit 112 receives three-color input color data RiGiBi and generates four-color output color data RoGoBoWo. The generated output color data RoGoBoWo may be transmitted to the accumulated color analysis unit 114 and the data driver 120. The data mapping unit 112 receives a gain ratio from the accumulated color analysis unit 114 to use the received gain ratio for generation of the four-color output color data RoGoBoWo.

The accumulated color analysis unit 114 may include an accumulator 164, a comparator 166, and a memory 165.

The accumulator 164 may receive four-color output data for each sub-pixel at every frame interval. The accumulator 164 accumulates color data of all pixels every frame for each color.

The accumulator 164 may transmit an accumulated sum of color data used for each sub-pixel to the comparator 166 at every frame or every frame separated by of an interval (e.g., a regular interval or predetermined interval).

The memory 165 may be a volatile memory or a nonvolatile memory. The memory 165 may be a read only memory (ROM) or a random access memory (RAM) including, a dynamic RAM (DRAM), a synchronous RAM (SRAM), a programmable RAM (PRAM), a resistive RAM (ReRAM), a magnetoresistive RAM (MRAM), or a ferroelectric RAM (FRAM). The memory 165 may also be a NOR flash memory, a NAND flash memory, or a fusion flash memory (e.g., a memory in which an SRAM buffer, a NAND flash memory and a NOR interface logic are combined).

The memory 165 may contain coefficients coeff used for a comparison operation of the comparator 166. The coefficients may include weights Wr, Wg, and Wb, which are multiplied to respective color data. The coefficients stored in the memory 165 may be updated. The weights Wr, Wg, and Wb may be determined based on the degradation tendency of the sub-pixels and the display condition.

The memory 165 may transmit the coefficients coeff used for the comparison operation to the comparator 166.

The comparator 166 may receive accumulated sums Nw, Nr, Ng, and Nb of color data used for respective sub-pixels from the accumulator 164 and receive the coefficients coeff used for the comparison operation from the memory 165.

The comparator 166 accumulates a product of color data used for each sub-pixel and their respective weights, thus calculating an R accumulated value, a G accumulated value, and a B accumulated value. The comparator 166 may calculate a W accumulated value by accumulating the value of color data used for white sub-pixels. The comparator 166 may compare a sum of the R accumulated value, the G accumulated value, and the B accumulated value with the W accumulated value.

In another embodiment of the present invention, the comparator 166 calculates, for the same frame, a sum of accumulated values of a product of the color data used for each sub-pixel and its respective weight, thus calculating an R accumulated value, a G accumulated value, and a B accumulated value. The comparator 166 calculates a sum of accumulated values of color data used for the white sub-pixels for the same frame, thus calculating the W accumulated value. The comparator 166 may compare a sum of the R accumulated value, the G accumulated value, and the B accumulated value with the W accumulated value.

The comparator 166 may decrease the gain ratio ga if the sum of the R accumulated value, the G accumulated value, and the B accumulated value is greater than the W accumulated value. Conversely, if the sum of the R accumulated value, the G accumulated value, and the B accumulated value is less than the W accumulated value, the comparator 166 may increase the gain ratio ga. The comparator 166 may determine a value by which the gain ratio ga is increased, according to a difference between the sum of the R accumulated value, the G accumulated value, and the B accumulated value and the W accumulated value.

The comparator 166 outputs the calculated gain ratio ga, and the accumulated color analysis unit 114 transmits the calculated gain ratio ga to the data mapping unit 112. The data mapping unit 112 performs RGB-to-RGBW conversion by using the updated gain ratio ga. Thus, the display device, according to an embodiment of the present invention, calculates an accumulated sum of color data used for each sub-pixel in a displayed image at every frame or every frame separated by a interval (e.g., a regular frame interval or predetermined frame interval), and performs an operation by using the calculated accumulated sum, thus properly adjusting the gain ratio ga. Therefore, the display device, according to an embodiment of the present invention, may implement pixels having both long-term lifespans and low power consumption.

Figure 7:
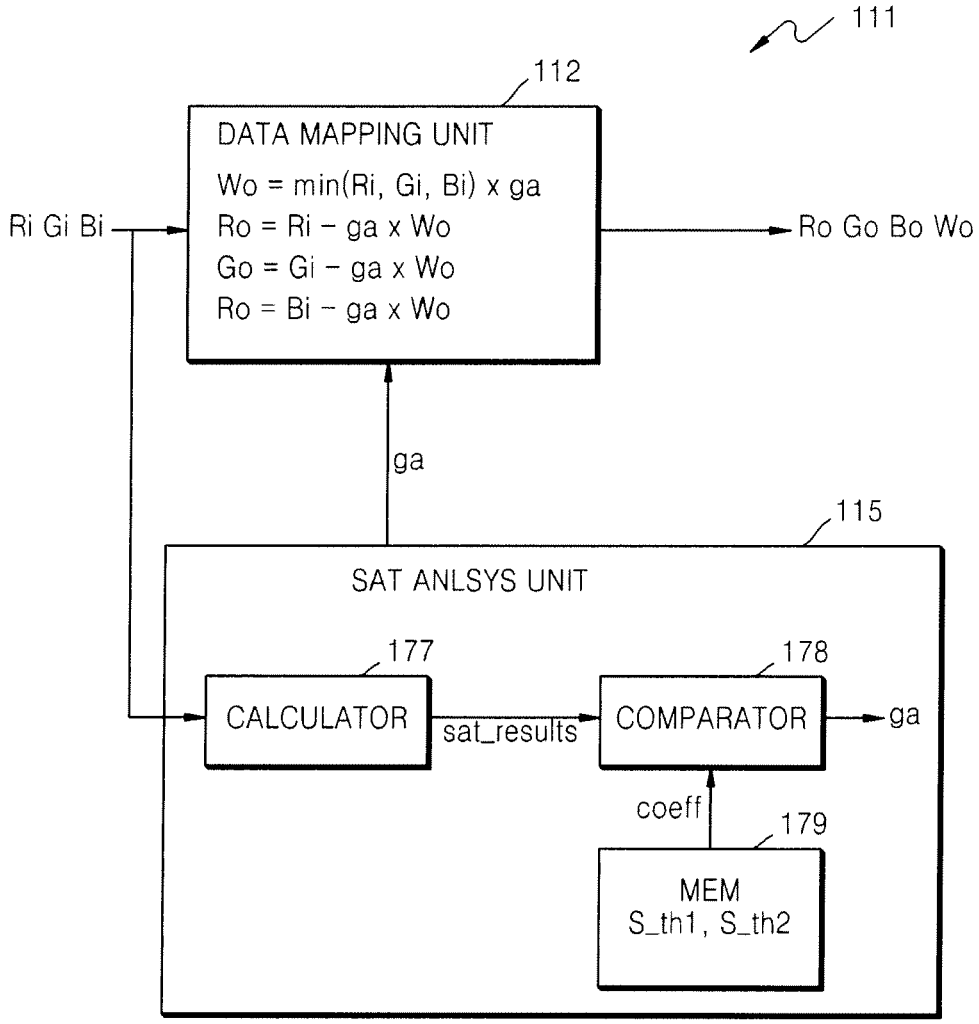
FIG. 7 is a diagram illustrating in detail an RGB-to-RGBW converter, according to an embodiment of the present invention.

FIG. 7 is a diagram illustrating in detail the RGB-to-RGBW converter 111-3 (which corresponds to RGB-to-RGBW converter 111 of FIG. 1), according to another embodiment of the present invention.

Referring to FIG. 7, the RGB-to-RGBW converter 111-3 includes the data mapping unit 112 and a saturation analysis unit 115.

The data mapping unit 112 and the memory 179 shown in FIG. 7 function in the same manner as the data mapping unit 112 and the memory 165 shown in FIG. 6, therefore a repeat discussion of the aforementioned components will not be provided.

The saturation analysis unit 115 includes a saturation calculator 177, a comparator 178, and a memory 179.

The saturation calculator 177 receives three-color input data RiGiBi and calculates a saturation of a corresponding frame sat_results by using the formulation:

$$\text{sat_results} = \frac{\min[r(i), g(i), b(i)]}{\max[r(i), g(i), b(i)]}, \tag{2}$$

wherein higher sat_results correspond to higher image saturation and, conversely, lower sat_results correspond to lower image saturation. Therefore, as sat_results increases, the gain ratio gr may be increased, such that overall power consumption is reduced, and as sat_results decreases, the gain ratio gr may be decreased, lengthening pixel lifespan.

The saturation calculator 177 may transmit the calculated saturation sat_results to the comparator 178.

The memory 179 may include a first reference value S_th1 and a second reference value S_th2 which are used for comparison in the comparator 178. The coefficients coeff stored in the memory 179 may be updated. The first reference value S_th1 and the second reference value S_th2 may be determined considering a display situation. The number of reference values may vary according to a display situation and the user's setting.

The memory 179 may transmit the coefficients coeff used for the comparison operation to the comparator 178.

The comparator 178 may compare the calculated saturation sat_results with the first reference value S_th1 and the second reference value S_th2. The value of the gain ratio may be adjusted based on the comparative relationship between the calculated sat_results and each of the first reference value S_th1 and the second reference value S_th2. For example, if the saturation of the current frame is greater than the first reference value S_th1, the gain ratio ga is reduced; if the saturation of the frame is less than the second reference value S_th2, the gain ratio ga is increased.

The comparator 178 outputs the calculated gain ratio ga, and the saturation analysis unit 115 transmits the calculated gain ratio ga to the data mapping unit 112. The data mapping unit 112 performs RGB-to-RGBW conversion by using the updated gain ratio ga. Therefore, by adjusting the gain ratio ga based on the saturation used in the displayed image, the display device 100 implements pixels having both long lifespan and low power consumption, according to one embodiment of the present invention.

Figure 8:
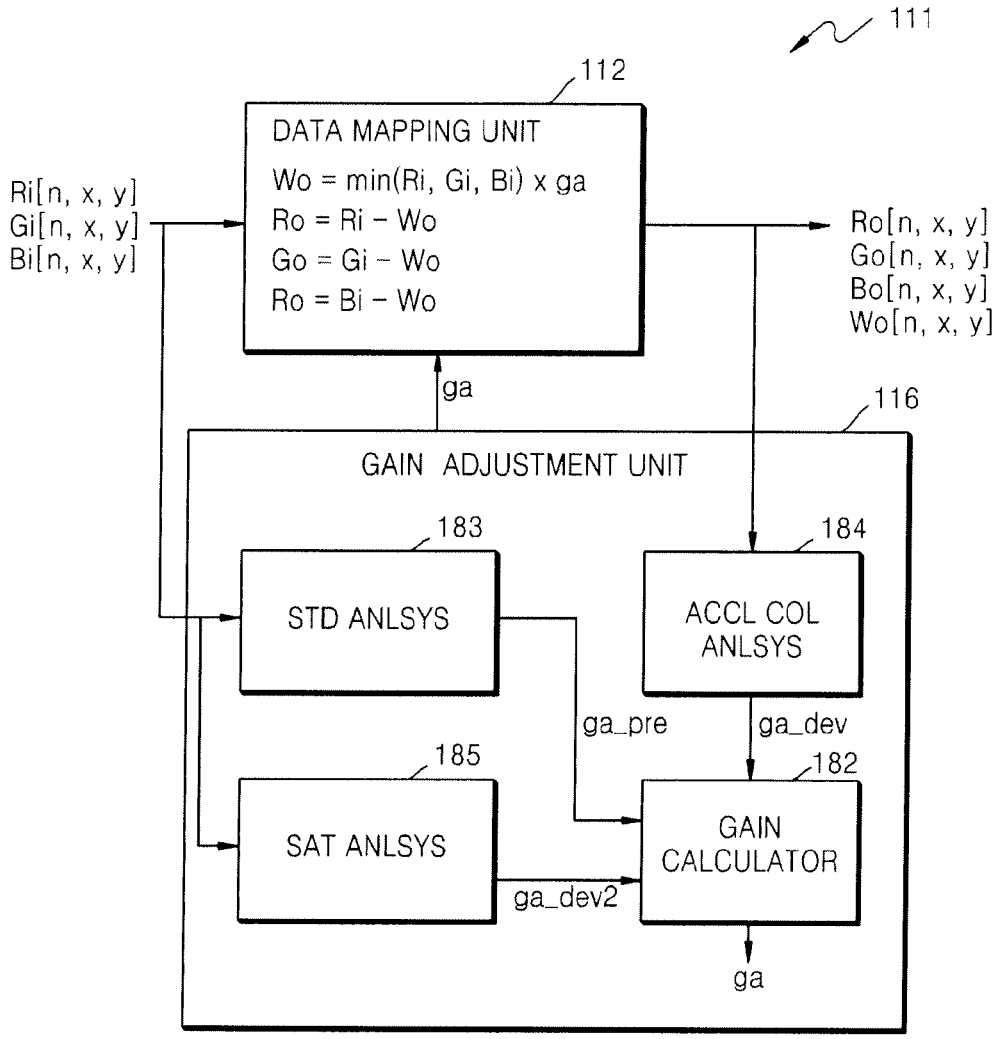
FIG. 8 is a diagram illustrating in detail an RGB-to-RGBW converter, according to an embodiment of the present invention.

FIG. 8 is a diagram illustrating in detail the RGB-to-RGBW converter 111-4 (which corresponds to RGB-to-RGBW converter 111 of FIG. 1), according to another embodiment of the present invention.

Referring to FIG. 8, the RGB-to-RGBW converter 111-4 includes the data mapping unit 112 and a gain adjustment unit 116.

The mapping unit 112 of FIG. 8 functions in the same manner as the data mapping unit 112 of FIG. 5, and thus a repetitive description will be avoided.

The gain adjustment unit 116 includes a gain calculator 182, a standard deviation analysis unit 183, an accumulated color analysis unit 184, and a saturation analysis unit 185.

The standard deviation analysis unit 183 may function in the same manner as the standard deviation analysis unit 113 of FIG. 5. For example, the standard deviation analysis unit 183 may include a deviation calculator 154 and a comparator 155, like the standard deviation analysis unit 113 of FIG. 5. The standard deviation analysis unit 183 may receive three-color input data Ri[n, x, y], Gi[n, x, y], and Bi[n, x, y] for each pixel position (x, y) for each frame. The standard deviation analysis unit 183 may calculate standard deviations of expected output color data for a test gain ratio ga_test. The standard deviation analysis unit 183 determines the test gain ratio ga_test corresponding to the minimum value of calculated standard deviations as a preliminary gain ratio ga_pre. The standard deviation analysis unit 183 may transmit the preliminary gain ratio ga_pre to the gain calculator 182.

The accumulated color analysis unit 184 may operate in a similar manner to the accumulated color analysis unit 114 of FIG. 6. For example, the accumulated color analysis unit 184 may include an accumulator 164, a comparator 166, and a memory 165, like the accumulated color analysis unit 114 of FIG. 6.

The accumulated color analysis unit 184 may receive four-color output data for each sub-pixel at frame intervals. The accumulated color analysis unit 184 sums color data of all pixels for each color every frame.

The accumulated color analysis unit 184 may include coefficients coeff used for comparison. The coefficients coeff used for comparison may include a weight to be multiplied to color data. The weights may be determined by the degradation tendency of the sub-pixels and the display situation.

The accumulated color analysis unit 184 accumulates a product of the color data used for each sub-pixel and the respective weight, thus calculating the R accumulated value, the G accumulated value, and the B accumulated value. The accumulated color analysis unit 184 may calculate the W accumulated value with an accumulated sum of color data used for the white sub-pixels. The accumulated color analysis unit 184 may compare the sum of the R accumulated value, the G accumulated value, and the B accumulated value with the W accumulated value.

In another embodiment of the present invention, the accumulated color analysis unit 184 calculates, for the current frame, a sum of accumulated values of a product of color data used for each sub-pixel and a weight, thus calculating the R accumulated value, the G accumulated value, and the B accumulated value. The accumulated color analysis unit 184 calculates a sum of accumulated values of color data used for the white sub-pixels for the same frame, thus calculating the W accumulated value. The accumulated color analysis unit 184 may compare the sum of the R accumulated value, the G accumulated value, and the B accumulated value with the W accumulated value.

The accumulated color analysis unit 184 decreases the gain ratio ga if the sum of the R accumulated value, the G accumulated value, and the B accumulated value is greater than the W accumulated value. When the sum of the R accumulated value, the G accumulated value, and the B accumulated value is less than the W accumulated value, the accumulated color analysis unit 184 may generate a first gain-ratio-change signal ga_dev1 to signal the increase of the gain ratio ga. The accumulated color analysis unit 184 may determine the value of the first gain ratio change signal ga_dev1 based on the difference between the sum of the R accumulated value, the G accumulated value, and the B accumulated value and the W accumulated value. The accumulated color analysis unit 184 transmits the calculated first gain-ratio-change-signal ga_dev1 to the gain calculator 182.

The saturation analysis unit 185 may operate like the saturation analysis unit 115 of FIG. 7. For example, the saturation analysis unit 185 may include a calculator 177, a comparator 178, and a memory 179 like the accumulated color analysis unit 114 of FIG. 6.

The saturation analysis unit 185 receives three-color input data RiGiBi and calculates a saturation of a corresponding frame, sat_results, by using the formulation:

$$\text{sat_results} = \frac{\min[r(i), g(i), b(i)]}{\max[r(i), g(i), b(i)]}. \tag{3}$$

The saturation analysis unit 185 may include the first reference value S_th1 and the second reference value S_th2 which are used for comparison in the comparator 178. The first reference value S_th1 and the second reference value S_th2 may be determined based on a display situation. The number of reference values may change according to a display situation and the user's setting.

The saturation analysis unit 185 may compare the calculated saturation sat_results with the first reference value S_th1 and the second reference value S_th2. The saturation analysis unit 185 may adjust a value of a second gain-ratio-change signal ga_dev2 based on the comparative relationship between the calculated sat_results and each of the first reference value S_th1 and the second reference value S_th2. The saturation analysis unit 185 transmits the second gain-ratio-change signal ga_dev2 to the gain calculator 182.

The gain calculator 182 receives the preliminary gain ratio ga_pre from the standard deviation analysis unit 183. The gain calculator 182 receives the first gain ratio change signal ga_dev1 from the accumulated color analysis unit 184. The gain calculator 182 receives the second gain ratio change signal ga_dev2 from the saturation analysis unit 185.

The gain calculator 182 calculates the gain ratio ga based on the received preliminary gain ratio ga_pre, first gain ratio change signal ga_dev1, and second gain ratio change signal ga_dev2. The gain ratio ga calculated by the gain calculator 182 is transmitted to the data mapping unit 112.

The gain adjustment unit 116, according to an embodiment of the present invention, includes the standard deviation analysis unit 183, the accumulated color analysis unit 184, and the saturation analysis unit 185 to determine the gain ratio based on the standard deviation, saturation, and used accumulated color data value of output color data.

The gain adjustment unit 116, according to another embodiment of the present invention, includes the standard deviation analysis unit 183 and the accumulated color analysis unit 184 to determine (e.g., optimally determine) the gain ratio ga based on the standard deviation and used accumulated color data value.

The gain adjustment unit 116, according to another embodiment of the present invention, includes the standard deviation analysis unit 183 and the saturation analysis unit 185 to determine (e.g., optimally determine) the gain ratio ga based on the standard deviation and the saturation.

Therefore, the display device 100, according to an embodiment of the present invention, may implement pixels having both a long lifespan and low power consumption.

Figure 9:
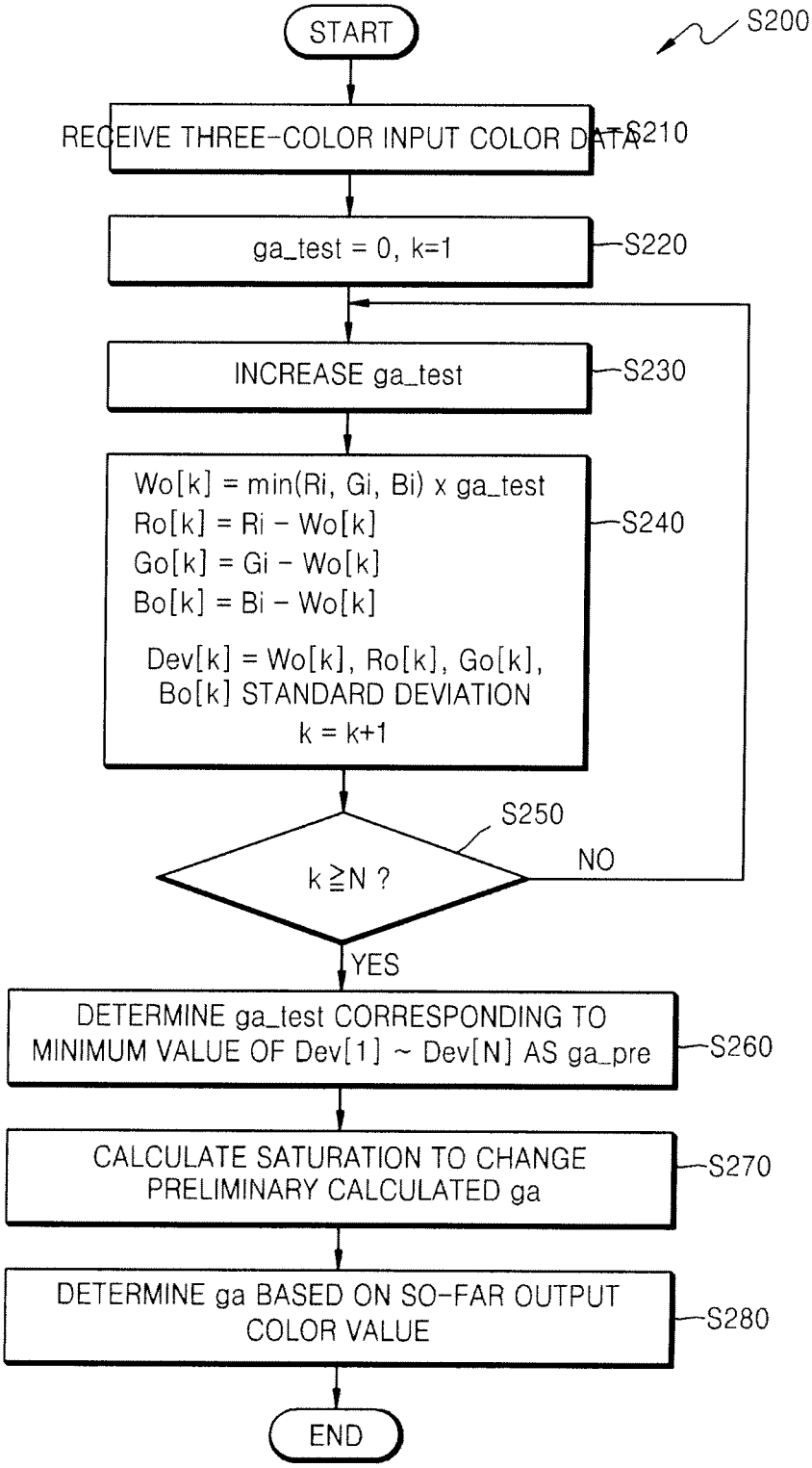
FIG. 9 is a flow diagram for describing an operation of a gain adjustment unit of FIG. 8, according to embodiments of the present invention.

FIG. 9 is a flow diagram for describing an operation of the gain adjustment unit 116 of FIG. 8, according to an embodiment of the present invention.

Referring to FIGS. 8 and 9, process S200 is a process of determining the gain ration ga based on the three-color input data. In step S210, the standard deviation analysis unit 183 may receive three-color input data. In step S220, the value of test gain ratio ga_test and index k are initialized to 0 and 1, respectively. In steps S230-S250, the standard deviation analysis unit 183 incrementally changes (at predetermined intervals) the value of ga_test (for each index k from 1 to a predetermined integer, N) and calculates the standard deviation Dev[k] of expected output color data Wo[k], Ro[k], Go[k], and Bo[k] for each increment of ga_test. In step 260, the standard deviation analysis unit 183 determines the ga_test value corresponding to the minimum of the calculated standard deviations and assigns that ga_test value to the preliminary gain ratio ga_pre.

In step 270, the saturation analysis unit 185 calculates the saturation, and the gain calculator 182 increases or decreases the preliminary gain ratio ga_pre based on the calculated saturation.

In step 280, the accumulated color analysis unit 184 calculates a difference between a sum of the R accumulated value, the G accumulated value, and the B accumulated value, and the W accumulated value. The gain calculator 182 increases or decreases the preliminary gain ratio ga_pre based on the calculated accumulated value.

Therefore, the display device 100, according to an embodiment of the present invention, may implement pixels having a long lifespan with low power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims, and their equivalents.

What is claimed is:

1. A display device comprising:

a data mapping unit configured to identify a minimum value of three-color input data corresponding to red, green, and blue, to determine white output color data by multiplying the identified minimum value by a gain ratio, and to subtract the white output color data from each of the three-color input data to determine red, green, and blue output color data;

a gain adjustment unit configured to determine a preliminary gain ratio corresponding to a minimum standard deviation of the white output color data and each of the red, green, and blue output color data, and to change the preliminary gain ratio based on an accumulated sum of color data used for respective sub-pixels in a previously displayed image to determine the gain ratio; and a display unit comprising unit pixels, each comprising red, green, blue, and white sub-pixels from among the respective sub-pixels, and configured to display an image corresponding to the white output color data and the red, green, and blue output color data.

2. The display device of claim 1, wherein the gain adjustment unit is configured to determine the gain ratio, for the respective unit pixels included in the display unit, based on the accumulated sum of color data used for the respective sub-pixels in the previously displayed image.

3. The display device of claim 1, wherein the gain adjustment unit is configured to determine the gain ratio, for every frame of the displayed image, based on the accumulated sum of color data used for the respective sub-pixels in the previously displayed image.

4. The display device of claim 1, wherein the gain adjustment unit is configured to receive the three-color input data, to calculate expected output color data for each of red, green, blue, and white with respect to a test gain ratio while changing the test gain ratio within a range of 0 and 1 at intervals, and to calculate standard deviations of the calculated expected output color data, and to determine the test gain ratio corresponding to a minimum of the calculated standard deviations of the calculated expected output color data as the preliminary gain ratio of a corresponding pixel.

5. The display device of claim 1, wherein the gain adjustment unit is further configured to change the gain ratio based on a saturation used in the displayed image.

6. The display device of claim 5, wherein the gain adjustment unit is configured to divide the minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

7. The display device of claim 6, wherein the saturation weight value is determined based on a display situation.

8. The display device of claim 1, wherein the gain adjustment unit is configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

9. A method of driving a display device comprising red, green, blue and white sub-pixels, the method comprising:

determining, by a gain adjustment unit, a preliminary gain ratio corresponding to a minimum standard deviation of white output color data and each of red, green, and blue output color data;

changing, by the gain adjustment unit, the preliminary gain ratio based on an accumulated sum of color data used for the respective sub-pixels in a previously displayed image to determine a gain ratio; and converting, by a data mapping unit, three-color input data corresponding to red, green, and blue into four-color output data corresponding to white, red, green, and blue by using the determined gain ratio.

10. The method of claim 9, wherein the converting, by the data mapping unit, the three-color input data into the four-color output data comprises:

identifying a minimum value of the three-color input data corresponding to red, green, and blue;

multiplying the identified minimum value by the gain ratio to determine the white output color data; and subtracting the white output color data from the respective three-color input data to determine the output color data of red, green, and blue.

11. The method of claim 9, further comprising displaying, by a display panel, an image corresponding to the white output color data and the red, green, and blue output color data.

12. The method of claim 9, further comprising determining, by the gain adjustment unit, the gain ratio, for respective unit pixels included in a display panel, based on the accumulated sum of color data used for the respective sub-pixels in a previously displayed image.

13. The method of claim 9, further comprising determining, by the gain adjustment unit, the gain ratio, for every frame of a displayed image, based on the accumulated sum of color data used for the respective sub-pixels in a previously displayed image.

14. The method of claim 9, wherein the determining, by the gain adjustment unit, the preliminary gain ratio comprises:

calculating expected output color data for each of red, green, blue, and white with respect to a test gain ratio while changing the test gain ratio;

calculating a standard deviation of the calculated expected output color data; and determining the test gain ratio corresponding to a minimum standard deviation of the calculated expected output color data as a preliminary gain ratio of a corresponding pixel.

15. The method of claim 9, further comprising changing, by the gain adjustment unit, the gain ratio based on a saturation used in the displayed image.

16. A display device comprising:

a display panel comprising a plurality of unit pixels, each comprising red, green, blue, and white sub-pixels;

a data driver configured to supply a four-color data signal corresponding to red, green, blue, and white output color data to each of the plurality of unit pixels;

a gate driver configured to supply a gate-on voltage to the plurality of unit pixels; and a timing controller configured to control a driving of the data driver and the gate driver and to supply the white output color data and output color data of the red, green, and blue sub-pixels to the data driver, wherein the timing controller comprises:

a data mapping unit configured to identify a minimum value of three-color input data corresponding to red, green, and blue, to determine white output color data by multiplying the identified minimum value by a gain ratio, and to subtract the white output color data from each of the three-color input data to determine output color data of red, green, and blue; and a gain adjustment unit configured to determine a preliminary gain ratio corresponding to a minimum standard deviation of the white output color data and each of the red, green, and blue output color data, and to change a preliminary gain ratio based on an accumulated sum of color data used for the respective red, green, blue, and white sub-pixels in a previously displayed image to determine the gain ratio.

17. The display device of claim 16, wherein the gain adjustment unit is configured to determine the gain ratio, for the respective plurality of unit pixels included in the display panel, based on the accumulated sum of color data used for the respective sub-pixels in the previously displayed image.

18. The display device of claim 16, wherein the gain adjustment unit is configured to determine the gain ratio, for every frame of the displayed image, based on the accumulated sum of color data used for the respective sub-pixels in the previously displayed image.

19. The display device of claim 16, wherein the gain adjustment unit is configured to receive the three-color input data, to calculate expected output color data for each of red, green, blue, and white with respect to a test gain ratio while changing the test gain ratio within a range of 0 and 1 at predetermined intervals, and to calculate standard deviations of the calculated expected output color data, and to determine the test gain ratio corresponding to a minimum of the calculated standard deviations of the calculated expected output color data as the preliminary gain ratio of a corresponding pixel.

20. The display device of claim 16, wherein the gain adjustment unit changes the gain ratio based on a saturation used in the displayed image.

21. The display device of claim 20, wherein the gain adjustment unit is configured to divide a minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

22. The display device of claim 21, wherein the saturation weight value is determined based on a display situation.

23. The display device of claim 16, wherein the gain adjustment unit is configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

24. A display device comprising:

a data mapping unit configured to identify a minimum value of three-color input data corresponding to red, green, and blue, to determine white output color data by multiplying the identified minimum value by a gain ratio, and to subtract the white output color data from each of the three-color input data to determine the red, green, and blue output color data;

a gain adjustment unit configured to determine a preliminary gain ratio corresponding to a minimum standard deviation of the white output color data and each of the red, green, and blue output color data, and to change the preliminary gain ratio based on an accumulated sum of color data used for respective sub-pixels in a previously displayed image and saturation data corresponding to the three-color input data, to determine the gain ratio for respective unit pixels included in a display panel; and a display unit comprising the unit pixels, each comprising red, green, blue, and white sub-pixels from among the respective sub-pixels, and displays an image corresponding to the white output color data and the red, green, and blue output color data.

25. The display device of claim 24, wherein the gain adjustment unit is configured to receive the three-color input data, to calculate expected output color data for each of red, green, blue, and white with respect to a test gain ratio while changing the test gain ratio within a range of 0 and 1 at predetermined intervals, and calculates standard deviations of the calculated expected output color data, and to determine the test gain ratio corresponding to a minimum of the calculated standard deviations of the calculated expected output color data as the preliminary gain ratio of a corresponding pixel.

26. The display device of claim 24, wherein the gain adjustment unit is configured to divide a minimum value of the three-color input data corresponding to red, green, and blue by a maximum value of the three-color input data corresponding to red, green, and blue to determine a saturation comparison value, to set a saturation weight value based on a comparative relationship between the saturation comparison value and each of one or more preset reference values, and to change the gain ratio by the saturation weight value.

27. The display device of claim 26, wherein the saturation weight value is determined based on a display situation.

28. The display device of claim 24, wherein the gain adjustment unit is configured to accumulate a product of color data previously used for the respective sub-pixels and a weight to calculate a R comparison value, a G comparison value, and a B comparison value, to accumulate color data used for white sub-pixels to calculate a W comparison value, and to compare a sum of the R comparison value, the G comparison value, and the B comparison value with the W comparison value to determine the gain ratio.

* * * * *